US008046098B2

(12) United States Patent
Paik

(10) Patent No.: US 8,046,098 B2
(45) Date of Patent: Oct. 25, 2011

(54) CURVED SURFACE FORMING METHOD OF A METAL PLATE

(76) Inventor: Jeom Kee Paik, Busan (KR)

( * ) Notice: Subject to any disclaimer, the term of this patent is extended or adjusted under 35 U.S.C. 154(b) by 309 days.

(21) Appl. No.: 12/522,338

(22) PCT Filed: Dec. 7, 2007

(86) PCT No.: PCT/KR2007/006350

§ 371 (c)(1),
(2), (4) Date: Jul. 7, 2009

(87) PCT Pub. No.: WO2008/084920

PCT Pub. Date: Jul. 17, 2008

(65) Prior Publication Data

US 2010/0030362 A1 Feb. 4, 2010

(30) Foreign Application Priority Data

Jan. 8, 2007 (KR) ..... 10-2007-0001919
Nov. 28, 2007 (KR) ..... 10-2007-0122224

(51) Int. Cl.

| | |
|---|---|
| ***G06F 19/00*** | (2011.01) |
| ***B21C 51/00*** | (2006.01) |
| ***B21D 55/00*** | (2006.01) |
| ***B21D 7/14*** | (2006.01) |

(52) U.S. Cl. ..... 700/165; 700/145; 700/182; 700/206; 72/28.1; 72/31.04

(58) Field of Classification Search ..... 700/90, 700/95, 97, 117, 122, 145, 159, 165, 180, 700/182, 186, 187, 206; 72/28.1, 31.01, 72/31.04, 31.1, 48, 127, 166, 176, 274, 380, 72/385

See application file for complete search history.

(56) References Cited

U.S. PATENT DOCUMENTS

| | | | | |
|---|---|---|---|---|
| 3,889,513 | A * | 6/1975 | Iwasaki et al. | 72/385 |
| 4,134,317 | A * | 1/1979 | Goel et al. | 83/35 |
| RE34,357 | E * | 8/1993 | Eckert et al. | 428/47 |
| 5,546,784 | A | 8/1996 | Haas et al. | |
| 5,673,477 | A * | 10/1997 | Hattori et al. | 29/825 |
| 7,354,804 | B2 * | 4/2008 | Kishimoto | 438/123 |
| 2009/0285687 | A1 * | 11/2009 | Yagami et al. | 416/179 |

FOREIGN PATENT DOCUMENTS

JP 1-133622 A 5/1989

(Continued)

OTHER PUBLICATIONS

A. Weisshaar et al., "Accurate and efficient CAD-oriented modeling of circular waveguide bends", IEEE MTT-S International Microwave Symposium Digest, vol. 3, Publication Year: 1997, pp. 1591-1594.*

(Continued)

*Primary Examiner* — Crystal J Barnes-Bullock
(74) *Attorney, Agent, or Firm* — Birch, Stewart, Kolasch & Birch, LLP

(57) ABSTRACT

Disclosed is a curved surface forming method for a metal plate. Nonlinear finite element analysis of elasto-plastic large deformation is performed on the metal plate. The metal plate to be worked is formed so as to have a three-dimensional target curved surface on the basis of the analysis results using a plurality of forming punches connected to a hydraulic apparatus. The curved surface formation method is very useful when the metal plate is worked for small quantity batch production.

13 Claims, 2 Drawing Sheets

FOREIGN PATENT DOCUMENTS

| | | | |
|---|---|---|---|
| JP | 6-226365 | A | 8/1994 |
| JP | 8-90089 | A | 4/1996 |

OTHER PUBLICATIONS

L. D. Gabbay et al., "Computer-aided generation of nonlinear reduced-order dynamic macromodels. I. Non-stress-stiffened case", Journal of Microelectromechanical Systems, vol. 9, Issue: 2, Publication Year: 2000, pp. 262-269.*

P. Thanapandi et al., "Algorithms for orthographic views with hidden entities and manufacturing features information for sheet metal parts", Canadian Conference on Electrical and Computer Engineering, vol. 2, Publication Year: 2001, pp. 1241-1246.*

* cited by examiner

CURVED SURFACE FORMING METHOD OF A METAL PLATE

TECHNICAL FIELD

The present invention relates to a curved surface forming method for a metal plate and, more particularly, to a curved surface forming method for a metal plate, which calculates required load and displacement by nonlinear finite element analysis of elasto-plastic large deformation of a metal plate with the aid of a dedicated program or a commercial program as is convenient for a user, and forms a target curved surface using a multi-point dieless forming apparatus.

BACKGROUND ART

Typically, bodies of vehicles, etc. are manufactured by pressing a metal thin plate into a pre-designed die. However, it is impossible in practice to manufacture them using a light-weight die made of a thick metal plate, etc. having various curved surfaces in the aspects of cost, time and so on.

General curved surface forming methods for a metal plate can be roughly classified into a cold forming method and a hot forming method. The hot forming method comprises bending a steel plate using the characteristic of the steel plate such that it shrinks locally when locally heated and rapidly cooled. For example, a method of working a ship steel plate generally employs two methods: hot working and cold working. Cold working causes plastic deformation of material by applying mechanical force to the material at room temperature using a press or a roller, whereas hot working bends a steel plate using the characteristic of the steel plate in which local shrinkage occurs when it is locally heated and rapidly cooled. Since the steel plate shows good machinability in a heated state, the hot working method of heating and bending the steel plate is frequently used. At present, the hot working mainly uses a line heating method using a gas torch etc. However, since this line heating method is highly dependent on the proficiency and experience of a worker, recently it has been very difficult to maintain uniform quality due to the aging and attrition of skilled workers. Furthermore, this line heating method is impossible to use in conjunction with a computer system, and thus has a limitation in the improvement of working efficiency.

The cold working method employs a bending roller and a hydraulic press. The bending roller includes three or four rollers disposed in a vertical direction. A steel plate is inserted into the gap between an upper roller and a lower roller and is pressed using a hydraulic jack coupled with the upper roller, and the rollers are rolled to bend and push out the steel plate. This process is repeated several times until a desired curved surface is formed. This cold working method is mainly suitable for bending plates having a two-dimensional curved surface among the external plates of a ship hull. In the case of a three-dimensional curved surface, a steel plate is roughly bent by the aforementioned process, and then is again worked such that a desired curved surface is obtained by the line heating method. Further, the hydraulic press is connected with a hydraulic apparatus, and is used to press the curved plate to form a desired curved surface. In the case in which mass production is required, the steel plate is hydraulically pressed by a stationary die module which is designed and manufactured in advance. In contrast, in the case in which small quantity batch production is required, meaning the case in which the number of curved plates to be worked is small, the stationary die module is manufactured at an enormous cost, and thus is impractical to apply in reality.

Recently, the demand for three-dimensional curved surface forming of various industrial metal plates such as ship steel plates for offshore plants for deep seabed mining and other various industries has increased sharply. At present, these curved plates are mainly formed by the hot working method, and thus encounter the difficulties described above. When the cold working method is applied, the number of workable workpieces is limited. In the case in which small quantity batch production is required, it is impossible in practice to design and manufacture the stationary die module. As a known useful method capable of overcoming this problem, a so-called multi-point forming method has been proposed. A forming apparatus applying this technology has been manufactured and is industrially available at present. The technical gist of the known multi-point forming method incorporated into the present invention is disclosed in "Review on Basic Forming Principle" (Study on Multi-point Sheet Forming Method, Vol. 1, M C Lee, et al), pages 519 to 522 of Japan Plastic Working Spring Lecture Meeting (May 24~26, 1992, Yokohama Japan), "Failure in Multi-point Forming and its Control" (Study on Multi-point Sheet Forming Method, Vol. 3), and pages 425 to 428 of the 43rd Japan Plastic Working Spring Lecture Meeting (Oct. 1~3, 1992, Tokyo Japan).

The multi-point forming method is a kind of cold working technology, to which a hydraulic press is basically applied, is a method of continuously arranging a series of steel punches, called forming punches, setting a die having a similar shape to a target curved surface, and carrying out forming through hydraulic pressing. Since this method can alter the shape of the die as needed, even if the number of workpieces to be worked is small as described above, various curved surfaces can be worked using a single forming apparatus. Moreover, the working environment for the forming is remarkably good compared to that of the existing hot working, and the existing hydraulic press can be used without change.

However, when a metal plate is plastic-worked by the hydraulic press, spring-back inevitably occurs. "Spring-back" refers to a phenomenon in which part of the metal plate elastically recovers upon deformation. In the complicated three-dimensional curved surface forming of the metal plate, spring-back is extremely complicated. The extent of spring-back varies according to the position within the curved surface. In spite of the many technical merits described above, when the multi-point forming method is used to form the complicated curved surface of the metal plate without checking the effects of spring-back in detail in advance, extensive work experience is required for precise formation. In order to obtain a target curved surface, a skilled worker must repeat the hydraulic pressing several times. As a result, there is a possibility of causing local damage to the worked workpiece. During forming, intermediate processes for checking whether or not the target curved surface is obtained are required. In this manner, a sophisticated, complicated process must be conducted by a highly skilled worker. Consequently, it takes a long time to manufacture the workpiece, and the quality of the formed workpiece varies according to the proficiency of the worker.

Thus, the development of technology capable of completely overcoming the problems with the multi-point forming method is acutely required. Moreover, although the demand for small quantity batch production for forming curved surfaces on metal plates has recently increased, the curved surface formation is still dependent on the experience of skilled workers. Thus, a limitation on the efficiency of production stems from the shortage of workers.

DISCLOSURE

Technical Problem

Accordingly, the present invention has been made in an effort to solve the problems occurring in the related art, and an object of the present invention is to provide a curved surface forming method for a metal plate, capable of rapidly and accurately forming a three-dimensional curved surface shape in a metal plate for manufacturing products used in various industrial fields without excessively depending on the proficiency or experience of a worker.

Technical Solution

In order to achieve the above object, according to one aspect of the present invention, there is provided a method of forming a metal plate into a desired shape having a curved surface using a multi-point dieless forming apparatus having a plurality of forming punches. The method comprises the step of: (a) inputting basic information, including dimensions and physical property values of the metal plate to be worked, into a computer system in which a program for nonlinear finite element analysis of elasto-plastic large deformation is installed; (b) defining a target curved surface of the to-be-worked metal plate by CAD work on the computer system; (c) determining, using the computer system, the distance between the target curved surface and a surface of the to-be-worked metal plate; (d) performing, using the computer system, the finite element analysis of elasto-plastic large deformation on the to-be-worked metal plate based on the input basic information, and obtaining a first load-displacement relation; (e) arranging positions of multiple forming punches of a forming apparatus connected to a hydraulic apparatus so as to be disposed in a vertical direction; (f) determining a second load-displacement relation required for forming at a position of each forming punch using the first load-displacement relation, which is obtained from the finite element analysis performed by the computer system; and (g) receiving information on the determined loads from a controller connected to the forming apparatus, performing numerical control on the hydraulic apparatus through the controller, and forming the to-be-worked metal plate, loaded between the forming punches arranged at upper and lower positions so as to approximate the target curved surface.

Here, the total amount of displacement that must be applied to each forming punch point may be set in order to calculate the spring-back effect of the metal plate to form the target curved surface in the finite element analysis of elasto-plastic large deformation at step (d).

At this time, the total amount of displacement that must be applied to each forming punch point may be set using the following equations (1) and (2):

$$K=OA/OB \tag{1}$$

$$OE=OB/K \tag{2}$$

where OA is the amount of residual permanent deformation of the metal plate, OB is the total amount of displacement of each forming punch point on the targeted curved surface, and OE is the total amount of displacement that must be applied to each forming punch point.

Further, the total amount of displacement that must be applied to each forming punch point may be set using the following equations (1) and (2):

$$AB=OB-OA=CD \tag{1}$$

$$OE=OB+CD \tag{2}$$

where OA is the amount of residual permanent deformation of the metal plate, OB is the total amount of displacement of each forming punch point on the targeted curved surface, and OE is the total amount of displacement that must be applied to each forming punch point.

Meanwhile, the method may further comprise the step of, after the step (g), measuring the formed curved surface of the to-be-worked metal plate, and comparing the measured curved surface with the target curved surface. Further, the method may further comprise the step of, when the formed curved surface measured in the comparing step exceeds an allowable error range, feeding the to-be-worked metal plate back to the forming apparatus, and forming the to-be-worked metal plate again.

In addition, the method may further comprise the step of, between the step (e) and the step (f), analyzing a relation between permanent deformation and elastic deformation of the to-be-worked metal plate at a position of each forming punch.

Advantageous Effects

As described above, according to the present invention, a three-dimensional curved plate having a target curved surface can be formed in an objective, uniform process without depending on the subjective experience of a skilled worker, so that the process of forming a desired target from the metal plate is very stable.

Further, whenever the metal plate is formed, the process is uniformly performed according to a scheduled procedure, so that a constant level of quality can be maintained. Particularly, compared to an existing manual forming method, which is based on experience, the curved surface forming time of the metal plate is remarkably reduced, so that the total time taken to manufacture the desired target can be reduced, which is very favorable from an economic standpoint.

DESCRIPTION OF REFERENCE NUMBERS OF MAIN PARTS IN DRAWINGS

Figure 1:
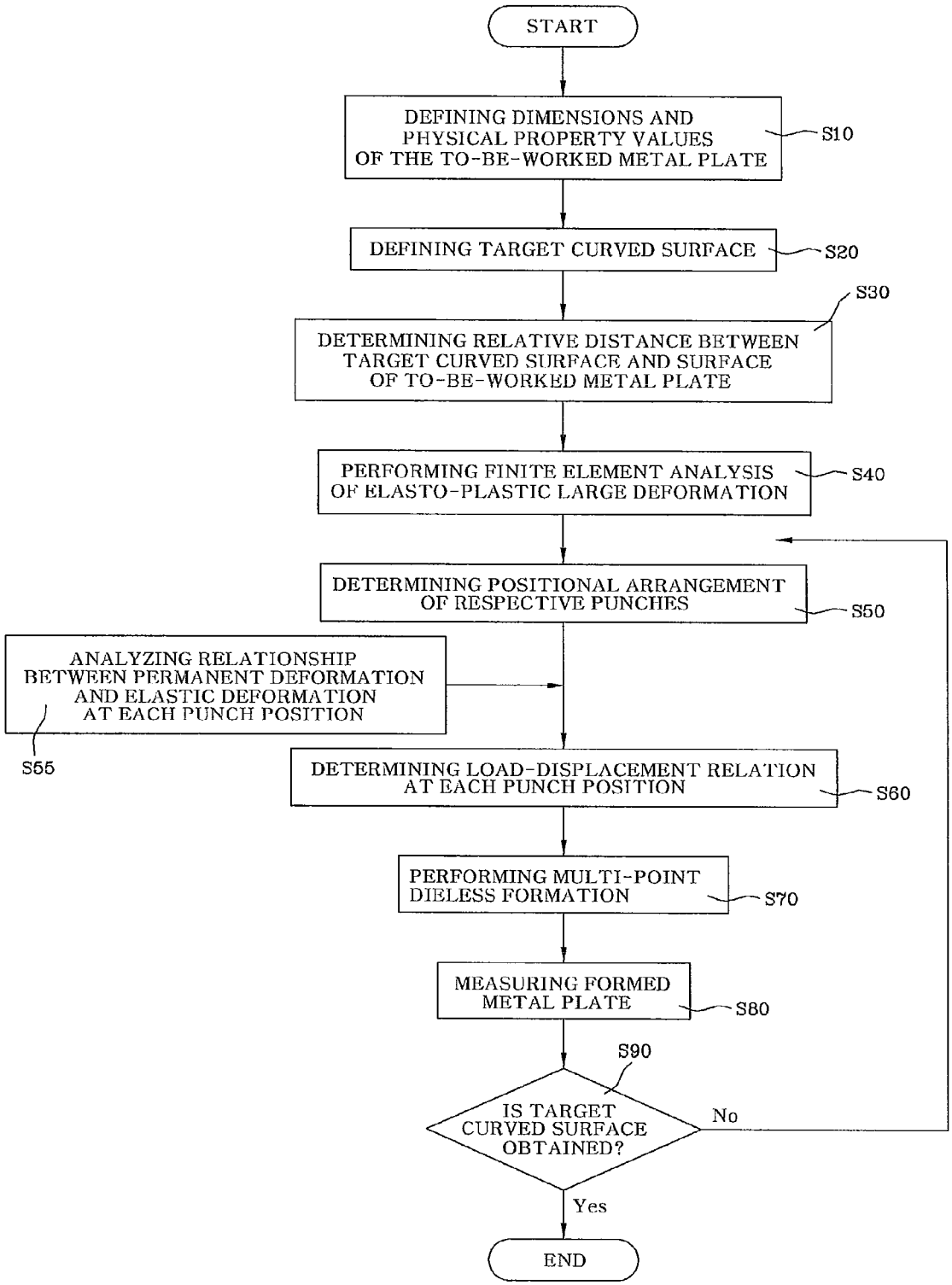
FIG. 1 is a process flow chart illustrating a curved surface forming method for a metal plate according to the present invention.

110: computer system
120: controller
130: forming apparatus

132: hydraulic apparatus
134, 136: forming punch
140: measuring device

MODE FOR INVENTION

Figure 2:
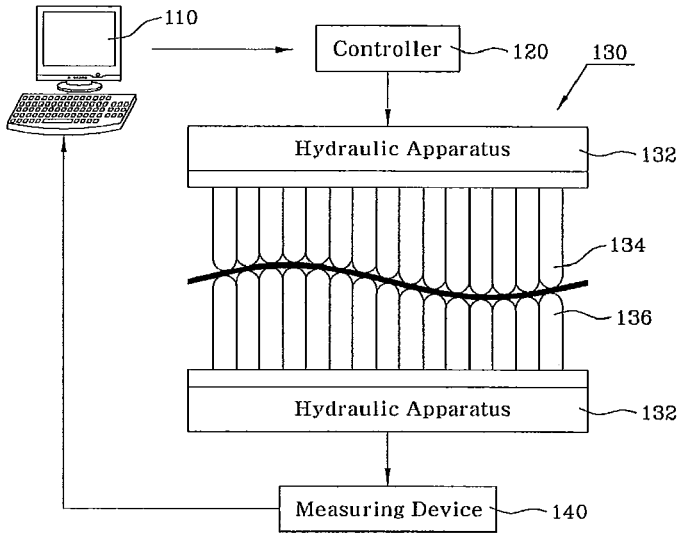
FIG. 2 is a system configuration view illustrating one example of a curved surface forming system for a metal plate according to the present invention.

Hereinafter, the technical principle of the present invention will be described with reference to the accompanying drawings. FIG. 1 is a process flow chart illustrating a curved surface forming method for a metal plate according to the present invention. FIG. 2 is a system configuration view illustrating one example of a curved surface forming system for a metal plate according to the present invention.

As illustrated in FIG. 2, the curved surface forming system, that is, the multi-point dieless forming system, according to the present invention fundamentally comprises a computer system 110, a controller 120, a forming apparatus 130, and a measuring device 140. The computer system 110 serves to input basic information for analyzing and working a metal plate to be worked, performs finite element analysis, and transmits information on the analysis results to the controller 120 connected to the forming apparatus 130. Further, the computer system 110 may store information on a target curved surface for a CAD program, and so on. The controller 120 functions to receive information on the curved surface forming, particularly the required load, from the computer system 100, and performs numerical control of the forming apparatus 130. The forming apparatus 130 comprises hydraulic apparatuses 132, and upper and lower forming punches 134 and 136 connected with the hydraulic apparatuses 132, and raises or lowers the lower forming punches 134 and 136 according to the required load and position control conditions by means of the controller 120 to thereby form the to-be-worked metal plate, which has been loaded between the upper and lower forming punches 134 and 136. The measuring device 140 measures the shape of the primary formed metal plate using a laser or the like, and then compares it with the target curved surface.

The multi-point dieless forming method according to the present invention undergoes several steps. First, the multi-point dieless forming method comprises the step S10 of defining the dimensions and physical property values of the to-be-worked metal plate, the step S20 of defining a required target curved surface according to the design specifications of a final product to be manufactured, the step S30 of determining the relative distance between the target curved surface and the surface of the to-be-worked metal plate, the step S40 of performing nonlinear finite element analysis of elasto-plastic large deformation on the to-be-worked metal plate, the step S50 of determining the positional arrangement of the respective punches, the step S55 of analyzing the relationship between permanent deformation and elastic deformation of the to-be-worked metal plate at the position of each punch, the step S60 of determining the load-displacement relation at each punch position, the step S70 of forming the to-be-worked metal plate so that it has the target curved surface using a multi-point dieless forming apparatus, and the step S80 of measuring the formed metal plate passing through the forming steps.

In the first step S10, the dimensions and physical property values of the to-be-worked metal plate are defined, and these pieces of information are input into the computer system 110, in which a program for analyzing the required load of the to-be-worked metal plate is installed. In this step, various pieces of information about the length, width and thickness of the to-be-worked metal plate are input together with information about the material, modulus of elasticity, stress-strain relation, and Poisson's ratio of the to-be-worked metal plate.

The second step S20 is a step of defining the curved surface as a worked target. In this step, the target curved surface of the metal plate is two- or three-dimensionally defined for the to-be-worked part of a designed product. Information on this target curved surface can be obtained by modeling based on CAD drawings created when the product is designed. Commercial software used for CAD includes ProENGINEER, CATIA, and so on. Alternatively, dedicated software individually developed so as to be suitable for specific use may be used. Further, software such as Rhino etc. is used for pre-processing initial input data before the finite element analysis of elasto-plastic large deformation is performed in order to predict the spring-back effect, as described below, so that a convenient computer working environment can be established.

In the third step S30, the relative distance between the target curved surface and the to-be-worked metal plate is determined. In other words, the relative distance or the coordinate position difference between the target curved surface extracted in the second step S20 and the surface of the to-be-worked metal plate, which usually has the shape of a flat plate, is calculated. This process can be executed by the CAD program for comparing coordinate positions between the target curved surface and the flat or curved surface of the to-be-worked metal plate.

Figure 3:
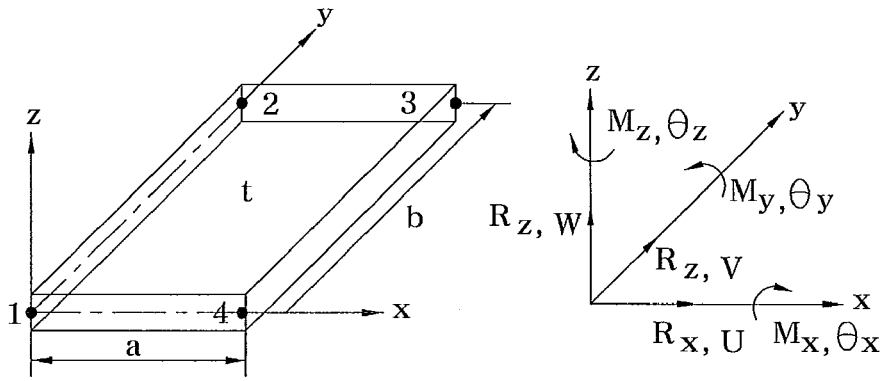
FIG. 3 illustrates a local coordinate system for a quadrilateral plate element, which has nodal load and displacement for performing nonlinear finite element analysis of elasto-plastic large deformation on a metal plate.

In the fourth step S40, the nonlinear finite element analysis of elasto-plastic large deformation is performed on the to-be-worked metal plate. A nonlinear structure analysis of elasto-plastic large deformation based on the finite element method is performed on the to-be-worked metal plate using the modulus of elasticity, the Poisson's ratio $\upsilon$, etc. which are input in the first step. In general, after any material goes through an elastic region and then a yield point in a stress-strain diagram thereof, the material is permanently deformed even after external force is removed from the material. This characteristic is called plasticity. The present invention serves to work the curved surface using this plastic characteristic of the to-be-worked metal plate. When any material having this elasto-plastic characteristic undergoes deformation, this is called elasto-plastic large deformation. In order to analyze such nonlinear elasto-plastic large deformation behavior, the present invention performs the nonlinear finite element analysis of elasto-plastic large deformation, as described below. FIG. 3 illustrates a local coordinate system for a quadrilateral plate element, which has a nodal load and displacement for performing the nonlinear finite element analysis of elasto-plastic large deformation on a metal plate for a ship.

I. Acquisition of Load-Displacement Relationship

1. Hypothesis Requirements

A. The plate exhibits geometrical nonlinearity such as twist, large deformation, and so on, and material nonlinearity, such as plasticity, yield, and so on.

B. The plate does not undergo ductile or brittle fracture.

C. The plate can be idealized as a set of a finite number of elements, i.e. finite elements.

D. Plastic behavior of material can be simply expressed by nodal points of the finite elements using a plastic node method.

2. Boundary Conditions

A. The boundary conditions of the plate can be idealized by constraining or controlling the degrees of freedom of displacement, i.e. axial displacement, rotational angle, etc. at the nodal point of each finite element.

B. The boundary conditions of the plate in the forming step can include perfect or partial freedom, perfect or partial support, perfect or partial fixing, or combinations thereof.

3. Shape of Element, Number of Nodal Points, and Degree of Freedom of Nodal Points A. Each finite element in use is a quadrilateral plate-shell element.

B. Four corners of each finite element have a single nodal point. The nodal point is located at the center of the thickness of the plate.

C. Each nodal point has 6 degrees of freedom, which includes x, y and z axial displacements in a three-dimensional space having x, y and z axes, and rotational angles around the x, y, z axes.

D. The displacement component of each nodal point is as follows.

$$\{U\}=\{u_1 v_1 w_1 \theta_{x1} \theta_{y1} \theta_{z1} \ldots u_4 v_4 w_4 \theta_{x4} \theta_{y4} \theta_{z4}\}^T \quad \text{Equation 1}$$

where u, v and w are the x, y and z axial displacements, $\theta_x$ (=−∂w/∂y), $\theta_y$ (=∂w/∂x) and $\theta_z$ are the rotational angles around the x, y and z axes, and $\{\ \}^T$ indicates the transposition of a vector.

E. Load component of each nodal point is as follows.

$$\{R\}=\{R_{x1} R_{y1} R_{z1} M_{x1} M_{y1} M_{z1} \ldots R_{x4} R_{y4} R_{z4} M_{x4} M_{y4} M_{z4}\}^T \quad \text{Equation 2}$$

where $R_x$, $R_y$ and $R_z$ are the x, y and z axial loads, $M_x$ and $M_y$ are the moments around the x and y axes, and $M_z$ is the twisting moment around the z axis.

4. Stress-Strain Relation and Strain-Displacement Relation which are to be Applied A. The stress-strain relation of each finite element is as follows.

$$\{\Delta\sigma\}=[D]^E\{\Delta\epsilon\}^E \quad \text{Equation 3}$$

where $\{\Delta\sigma\}=\{\Delta\sigma_x\ \Delta\sigma_y\ \Delta\tau_{xy}\}^T$ indicates the increment of the stress component, and $\{\Delta\epsilon\}=\{\Delta\epsilon_x\ \Delta\epsilon_y\ \Delta\gamma_{xy}\}^T$ indicates the increment of the strain component. The superscript E indicates that it is within an elasticity range. $[D]^E$ is the stress-strain matrix, which is expressed as follows.

$$[D]^E = \frac{E}{1-\nu^2}\begin{bmatrix} 1 & \nu & 0 \\ \nu & 1 & 0 \\ 0 & 0 & \frac{1-\nu}{2} \end{bmatrix}$$

where E is the modulus of elasticity, and υ is the Poisson's ratio.

B. The strain-displacement relation of each finite element is as follows, in consideration of geometrical nonlinearity.

$$\varepsilon_x = \frac{\partial u}{\partial x} - z\frac{\partial^2 w}{\partial x^2} + \frac{1}{2}\left\{\left(\frac{\partial u}{\partial x}\right)^2 + \left(\frac{\partial v}{\partial x}\right)^2\right\} + \frac{1}{2}\left(\frac{\partial w}{\partial x}\right)^2 \quad \text{Equation 4}$$

$$\varepsilon_y = \frac{\partial v}{\partial y} - z\frac{\partial^2 w}{\partial y^2} + \frac{1}{2}\left\{\left(\frac{\partial u}{\partial y}\right)^2 + \left(\frac{\partial v}{\partial y}\right)^2\right\} + \frac{1}{2}\left(\frac{\partial w}{\partial y}\right)^2$$

$$\gamma_{xy} = \left(\frac{\partial u}{\partial y} + \frac{\partial v}{\partial x}\right) - 2z\frac{\partial^2 w}{\partial x \partial y} + \left\{\left(\frac{\partial u}{\partial x}\right)\left(\frac{\partial u}{\partial y}\right) + \left(\frac{\partial v}{\partial x}\right)\left(\frac{\partial v}{\partial y}\right)\right\} + \left(\frac{\partial w}{\partial x}\right)\left(\frac{\partial w}{\partial y}\right)$$

-continued $$\Delta\varepsilon_x = \frac{\partial \Delta u}{\partial x} - z\frac{\partial^2 \Delta w}{\partial x^2} + \left(\frac{\partial u}{\partial x}\right)\left(\frac{\partial \Delta u}{\partial x}\right) + \left(\frac{\partial v}{\partial x}\right)\left(\frac{\partial \Delta v}{\partial x}\right) + \left(\frac{\partial w}{\partial x}\right)\left(\frac{\partial \Delta w}{\partial x}\right) + \frac{1}{2}\left\{\left(\frac{\partial \Delta u}{\partial x}\right)^2 + \left(\frac{\partial \Delta v}{\partial x}\right)^2\right\} + \frac{1}{2}\left(\frac{\partial \Delta w}{\partial x}\right)^2$$

$$\Delta\varepsilon_y = \frac{\partial \Delta v}{\partial y} - z\frac{\partial^2 \Delta w}{\partial y^2} + \left(\frac{\partial u}{\partial y}\right)\left(\frac{\partial \Delta u}{\partial y}\right) + \left(\frac{\partial v}{\partial y}\right)\left(\frac{\partial \Delta v}{\partial y}\right) + \left(\frac{\partial w}{\partial y}\right)\left(\frac{\partial \Delta w}{\partial y}\right) + \frac{1}{2}\left\{\left(\frac{\partial \Delta u}{\partial y}\right)^2 + \left(\frac{\partial \Delta v}{\partial y}\right)^2\right\} + \frac{1}{2}\left(\frac{\partial \Delta w}{\partial y}\right)^2$$

$$\Delta\gamma_{xy} = \left(\frac{\partial \Delta u}{\partial y} + \frac{\partial \Delta v}{\partial x}\right) - 2z\frac{\partial^2 \Delta w}{\partial x \partial y} + \left(\frac{\partial u}{\partial x}\right)\left(\frac{\partial \Delta u}{\partial y}\right) + \left(\frac{\partial u}{\partial y}\right)\left(\frac{\partial \Delta u}{\partial x}\right) + \left(\frac{\partial v}{\partial x}\right)\left(\frac{\partial \Delta v}{\partial y}\right) + \left(\frac{\partial v}{\partial y}\right)\left(\frac{\partial \Delta v}{\partial x}\right) + \left(\frac{\partial w}{\partial x}\right)\left(\frac{\partial \Delta w}{\partial y}\right) + \left(\frac{\partial w}{\partial y}\right)\left(\frac{\partial \Delta w}{\partial x}\right) + \left(\frac{\partial \Delta u}{\partial x}\right)\left(\frac{\partial \Delta u}{\partial y}\right) + \left(\frac{\partial \Delta v}{\partial x}\right)\left(\frac{\partial \Delta v}{\partial y}\right) + \left(\frac{\partial \Delta w}{\partial x}\right)\left(\frac{\partial \Delta w}{\partial y}\right)$$

where the Δ indicates respective changes.

5. Application of Equilibrium Condition Between External Work and Internal Work

A. The principle of virtual work is applied.

B. The following equation is derived from the condition that the external work done by external force and virtual displacement and the internal work done by stress and virtual displacement should in equilibrium.

$$\delta\{\Delta U\}^T\{R+\Delta R\}=\int_v \delta\{\Delta\epsilon\}^T\{\sigma+\Delta\sigma\}d\text{vol} \quad \text{Equation 5}$$

where $\int_v(\ )d\text{vol}$ indicates the volume integral of the entire system, and δ indication the virtual value.

C. In order to obtain a high level of analysis results, unbalanced force of the internal and external force occurring during the analysis according to the increment of the external load process should be removed. To this end, various numerical techniques based on iterative operations, such as the Newton-Raphson method, are mainly used.

6. Derivation of Elastic Tangential Stiffness Equation of Finite Elements

A. When the equilibrium condition expression applying the principle of virtual work is developed in detail, the load-displacement relation of each finite element is derived within an elasticity range.

B. The elastic tangential stiffness equation, considering geometrical nonlinearity (twist, large deformation) is as follows.

$$\{\Delta R\} = [K]^E\{\Delta U\} \quad \text{Equation 6}$$

where $[K]^E = [K_p] + [K_b] + [K_g] + [K_\sigma]$,

= the elastic tangential stiffness matrix $$[K_p] = \begin{bmatrix} [K_1] & 0 \\ 0 & 0 \end{bmatrix},\ [K_b] = \begin{bmatrix} 0 & 0 \\ 0 & [K_2] \end{bmatrix},\ [K_g] = \begin{bmatrix} [K_3] & [K_4] \\ [K_4]^T & [K_5] \end{bmatrix}$$

$$[K_\sigma] = \begin{bmatrix} [K_6] & 0 \\ 0 & [K_7] \end{bmatrix}$$

$$[K_1] = \int_v [B_p]^T[D]^T[B_p]d\text{vol}$$

$$[K_2] = \int_v [B_b]^T[D]^e[B_b]z^2 d\text{vol}$$

-continued $$[K_3] = \int_v [G_p]^T [C_p]^T [D]^E [B_p] dvol + \int_v [B_p]^T [D]^E [C_p][G_p] dvol + \int_v [G_p]^T [C_p]^T [D]^e [C_p][G_p] dvol$$

$$[K_4] = \int_v [B_p]^T [D]^E [C_b][G_p] dvol + \int_v [G_p]^T [C_p]^T [D]^E [C_b][G_b] dvol$$

$$[K_5] = \int_v [G_p]^T [C_b]^T [D]^E [C_b][G_b] dvol$$

$$[K_6] = \int_v [G_p]^T [\sigma_p][G_b] dvol$$

$$[K_7] = \int_v [G_b]^T [\sigma_b][G_b] dvol$$

$$[\sigma_p] = \begin{bmatrix} \sigma_x & 0 & \tau_{xy} & 0 \\ 0 & \sigma_x & 0 & \tau_{xy} \\ \tau_{xy} & 0 & \sigma_y & 0 \\ 0 & \tau_{xy} & 0 & \sigma_y \end{bmatrix}$$

$$[\sigma_b] = \begin{bmatrix} \sigma_x & \tau_{xy} \\ \tau_{xy} & \sigma_y \end{bmatrix}$$

$$\{U\} = \{SW\}^T$$

$$\{S\} = \{u_1 \quad v_1 \quad u_2 \quad v_2 \quad u_3 \quad v_3 \quad u_4 \quad v_4\}^T$$

$$\{W\} = \{w_1 \quad \theta_{x1} \quad \theta_{y1} \quad w_2 \quad \theta_{x2} \quad \theta_{y2} \quad w_3 \quad \theta_{x3} \quad \theta_{y3} \quad w_4 \quad \theta_{x4} \quad \theta_{y4}\}^T$$

$$\left\{\frac{\partial u}{\partial x} \frac{\partial v}{\partial y} \frac{\partial u}{\partial y} + \frac{\partial v}{\partial x}\right\}^T = [B_p]\{S\}$$

$$\left\{\frac{\partial^2 w}{\partial x^2} \frac{\partial^2 w}{\partial y^2} 2\frac{\partial^2 w}{\partial x \partial y}\right\}^T = [B_b]\{W\}$$

$$\left\{\frac{\partial u}{\partial x} \frac{\partial v}{\partial x} \frac{\partial u}{\partial y} \frac{\partial v}{\partial y}\right\}^T [G_p]\{S\}$$

$$\left\{\frac{\partial w}{\partial x} \frac{\partial w}{\partial y}\right\}^T = [G_b]\{W\}$$

$$[C_p] = \begin{bmatrix} \frac{\partial u}{\partial x} & \frac{\partial v}{\partial x} & 0 & 0 \\ 0 & 0 & \frac{\partial u}{\partial y} & \frac{\partial v}{\partial y} \\ \frac{\partial u}{\partial y} & \frac{\partial v}{\partial y} & \frac{\partial u}{\partial x} & \frac{\partial v}{\partial x} \end{bmatrix}$$

$$[C_b] = \begin{bmatrix} \frac{\partial w}{\partial x} & 0 \\ 0 & \frac{\partial w}{\partial y} \\ \frac{\partial w}{\partial y} & \frac{\partial w}{\partial x} \end{bmatrix}$$

7. Derivation of Elastic-Plastic Tangential Stiffness Equation of Finite Elements A. The effects of plastic yield are considered by applying the plastic node method, in which the plastic nodal point is inserted into the nodal point of each finite element when indicated.

B. The elastic-plastic tangential stiffness equation, considering the large deformation effects as well as the plasticity effects, is obtained as follows.

Equation 7

$$\{\Delta R\} = \left([K]^E - \frac{[K]^E[\phi][\phi]^T[K]^E}{[\phi]^T[K]^E[\phi]}\right)$$

$$\{\Delta U\} = [K]^p\{\Delta U\}$$

where $$[K]^p = [K]^E - \frac{[K]^E[\phi][\phi]^T[K]^E}{[\phi]^T[K]^E[\phi]}$$

= the elastic-plastic tangential stiffness matrix $$\{\phi_i\} = \sigma_Y^2\left(\left\{\frac{\partial f_i}{\partial \sigma_i}\right\}^T \left\{\frac{\partial \sigma_i}{\partial R}\right\} + \left\{\frac{\partial f_i}{\partial \sigma_{bi}}\right\}^T \left\{\frac{\partial \sigma_{bi}}{\partial R_w}\right\}\right)$$

where $f_i$=the plasticity condition of the nodal point i, $\sigma_y$=the yield stress, $\sigma_i$=the membrane stress component of the nodal point i, $\sigma_{bi}$=the bending stress component of the nodal point i, R=the in-plane node force component, and $R_w$=the out-plane node force component.

8. Derivation of Load-Displacement Relation (Stiffness Equation) of Entire Plate A. The coordinate transform matrix of each finite element constituting the plate is defined as a function of the coordinate system at a finite element level.

B. The stiffness equation of each finite element is coordinate-transformed with respect to the coordinate system of the entire plate, and then is combined with respect to the entire plate.

In this manner, when the nonlinear finite element analysis of elasto-plastic large deformation is performed on the to-be-worked metal plate, the relative distance between the target curved surface determined in the third step S30 and the to-be-worked metal plate, i.e. the required load for the working displacement, can be calculated.

II. Prediction of Spring-Back Effect

Here, when the finite element analysis of elasto-plastic large deformation is performed, the detailed spring-back effect on the three-dimensional curved surface of the to-be-worked metal plate can be predicted. The finite element analysis can be performed using an existing commercial program, such as ANSYS, ABAQUS, MARC, etc., for the finite element analysis of elasto-plastic large deformation, or a dedicated program that is directly programmed. The post-processing of the results of the finite element analysis of elasto-plastic large deformation includes a process of visually displaying deformation diagrams, stress distribution diagrams, strain distribution diagrams, etc. on the monitor of a computer. The post-processing can also establish the same working environment as the pre-processing by applying software such as Rhino or the like. The spring-back effect according to the elasto-plastic formation is predicted according to the following sequence with reference to FIG. 4.

Figure 4:
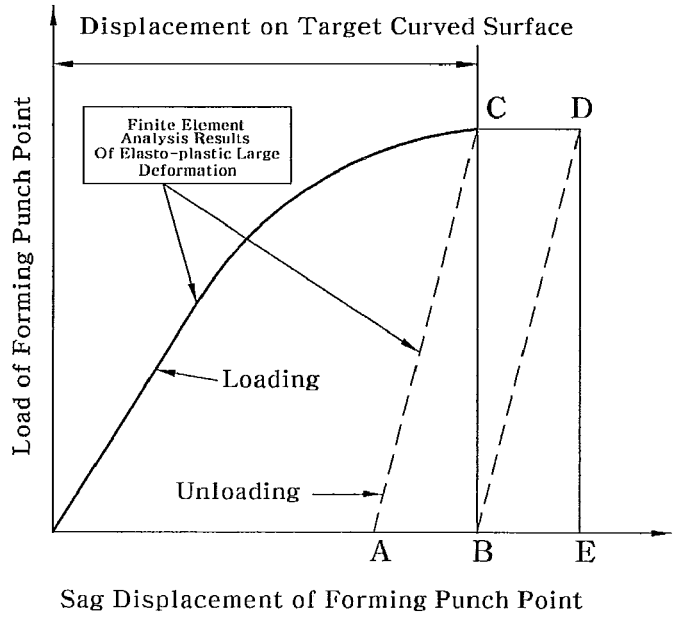
FIG. 4 is a graph showing a load-displacement curve associated with the calculation of an amount of required sag displacement of a metal plate in order to analyze a spring-back effect.

1. The elasto-plastic large deformation analysis is performed on the to-be-worked metal plate using a finite element analysis program while sag displacement corresponding to each point on the target curved surface is incrementally applied to the position of a forming punch point by a displacement control method. The size of each finite element is preferably set so as to be equal to a previously defined interval between the forming punches. After the elasto-plastic large deformation analysis is performed, the analysis results including a relation curve of the load (reaction) and the sag displacement at each forming punch point are obtained. That is, a curve OC of FIG. 4 is obtained. The analysis results can be visually presented on the computer monitor in real time.

2. After the sag displacement is incrementally applied to a predetermined amount of displacement of the target curved surface defined in the item 1 or its surroundings using the finite element analysis program, the load (reaction) occurring at each forming punch point is removed. The finite element analysis is continued until the load of each punch point is completely removed (i.e. reaches zero (0)). That is, a line CA of FIG. 4 is additionally obtained. Line CA is generally a curved line, but it is nearly a straight line. After the unloading process is completed, the elastic component AB of the elasto-plastic deformation occurring up to that point disappears, and a plastic component OA, i.e. permanent sag deformation, remains. The amount of this permanent sag deformation corresponds to the amount of the formed sag displacement of each forming punch point. However, the distribution of the permanent sag deformation amounts of the respective forming punch points does not match the displacement amount on the target curved surface of the to-be-worked metal plate, because the total of the sag displacement amounts of the respective forming punch points, applied previously, does not consider the spring-back effect.

3. Thus, the results of the finite element analysis of elasto-plastic large deformation, which are obtained from items 1 and 2, enable the spring-back effect to be analyzed by the following two methods in consideration of an elastic spring-back amount corresponding to a spring-back rate AB in the vicinity of the sag displacement of the target curved surface of the to-be-worked metal plate.

Method 1

$$K = \frac{OA}{OB} \tag{1}$$

where OA is the amount of residual permanent deformation, OB is the total amount of displacement on the target curved surface of the forming punch point, and K indicates the spring-back effect rate of the specific forming punch point of the to-be-worked metal plate.

Assuming that the spring-back effects according to the change in micro displacement amount in the vicinity of the sag displacement amount of the target curved surface of the to-be-worked metal plate are the same, the total amount OE of sag displacement, which should be applied so as to be able to obtain the target curved surface of the to-be-worked metal plate by applying the spring-back effect estimated in equation 1, can be calculated using the following equation.

$$OE = \frac{OB}{K} \tag{2}$$

where OE indicates the total amount of displacement required to obtain the target curved surface at the specific forming punch point.

Method 2

First, the total displacement of the forming punches is applied in a magnitude corresponding to the sag displacement on the target curved surface, and then unloading is performed. Thereby, the amount AB of spring-back displacement is calculated as follows.

$$AB=OB-OA=CD \tag{3}$$

Next, assuming that the spring-back effects on the sag displacement of specific forming punch points in the vicinity of the target curved surface of the to-be-worked metal plate are the same, the following displacement CD can be assumed.

$$CD=AB \tag{4}$$

Thus, the amount OE of entire required displacement of each forming punch point that should be applied in order to obtain the target curved surface of the to-be-worked metal plate is calculated as follows.

$$OE=OB+CD \tag{5}$$

4. When the processes of the items 1, 2 and 3 are performed on all the forming punch points within the to-be-worked metal plate, the total amount of displacement of each forming punch point required to obtain the target curved surface of the to-be-worked metal plate, in which the spring-back effect is considered at each punch point, is obtained. This total amount of required displacement is used to determine the positional arrangement of the forming punches.

In the fifth step S50, the number and positional arrangement of the forming punches 134 and 136 to which the results obtained in the fourth step S40 are to be applied are determined. If the number of forming punches 134 and 136 is increased, more precise curved surface forming is possible. However, in consideration of the size of the forming apparatus, the required precision of the curved surface, and so on, the number of forming punches is determined. The size of the forming apparatus 130 can be designed and manufactured in consideration of the dimensions of the to-be-worked metal plate. Preferably, the forming punches 134 and 136 have strong columns made of steel so as to be able to sufficiently withstand a load, and the diameter of each column is set to be equal to the interval between the forming punches, so that the upper and lower forming punches are disposed so as to be opposite each other.

In the sixth step S60, the load-displacement relationship is determined at the position of each punch on the basis of the information on the required load and displacement of each element, which are the results of nonlinear finite element analysis performed as described above. In other words, the load or displacement required for the target curved surface formation is applied to the forming punches 134 and 136 corresponding to each position on the to-be-worked metal plate according to the results of the finite element analysis performed in the fourth step S40.

The process of analyzing the relationship between the elastic deformation and the permanent deformation of the metal plate in order to predict the spring-back effect may be performed between the fifth and sixth steps.

In the seventh step S70, the forming punches 134 and 136 connected to the hydraulic apparatus 132 move up and down on the basis of the information on the loads of the forming punches 134 and 136 obtained in the previous step, and thereby the to-be-worked metal plate loaded between the upper and lower forming punches 134 and 136 is formed so as to have the curved surface. The hydraulic apparatus 132 is controlled by the controller 120, which receives the information on the required displacement and load from the computer system 110. At this time, the upper and lower forming punches 134 and 136 are stationary, or move according to the conditions of given load and displacement, thereby pressing the to-be-worked metal plate to form a desired curved surface. The applied maximum load of the hydraulic apparatus 132 is designed in consideration of the dimensions, such as thickness, and material physical property values of the to-be-worked metal plate.

In the eighth step S80, the curved surface of the to-be-worked metal plate which is formed through the aforementioned processes is measured to check whether or not it reaches the target curved surface. The curved surface of the to-be-worked metal plate generally has the three-dimensional shape, and thus technology for measuring the three-dimensional shape is used. For the purpose of measuring the three-dimensional shape, either a contact type three-dimensional measuring device or a non-contact type three-dimensional measuring device using light can be used. In the case in which the contact type three-dimensional measuring device is used, each point on the formed curved surface of the metal plate is measured, so that an overall curved surface shape can be measured. In contrast, in the case in which the non-contact type three-dimensional measuring device is used, a Moire technique of applying light to obtain information about the shape can be used. In the Moire technique, light is applied to the formed curved surface of the metal plate, and a grid of linear fringes is formed at regular intervals. Thereby, a Moire pattern having three-dimensional shape information on the measured target is obtained. The surface shape of the measured target can be measured by analyzing the Moire pattern. Another method is phase measurement profilometry (PMP), in which sine wave light is applied to a fine projection grid, the light passing through the projection grid is projected onto the formed metal plate, and the projection grid is phase-transited to divide the phase of the grid as much as possible. The shape of the curved surface of the formed metal plate is measured by this method of measuring the three-dimensional shape, and thereby the information on the curved surface is extracted. In the ninth step S90, the extracted information is compared with the information on the target curved surface. If the compared result is within a preset working error range, the curved surface forming is terminated. In contrast, if the compared result exceeds a preset working error range, the primarily formed metal plate is fed back to the third step S30, and then undergoes the forming again.

The formed metal plate reaching the target curved surface through the aforementioned processes will be delivered to the subsequent assembling process.

In this manner, according to the present invention, whatever the formed target, that is, the workpiece, is a ship or part of some other industrial structure, it can be formed into a desired curved surface using only the basic information on the metal plate and the information on the target curved surface. The present invention can be implemented regardless of the material of the metal plate, such as whether it is a steel plate or an aluminum plate, and the thickness of the metal plate, that is, whether it is a thin plate or a thick plate.

The invention claimed is:

1. A method of forming a metal plate into a desired shape having a curved surface using a multi-point dieless forming apparatus having a plurality of forming punches, the method comprising the step of:

(a) inputting basic information including dimensions and physical property values of the metal plate to be worked into a computer system in which a program for nonlinear finite element analysis of elasto-plastic large deformation is installed;

(b) defining a target curved surface of the to-be-worked metal plate by CAD work on the computer system;

(c) determining, using the computer system, a relative distance between the target curved surface and a surface of the to-be-worked metal plate;

(d) performing, using the computer system, the finite element analysis of elasto-plastic large deformation on the to-be-worked metal plate based on the input basic information, and obtaining a first load-displacement relation;

(e) arranging positions of multiple forming punches of a forming apparatus connected to a hydraulic apparatus so as to dispose them in a vertical direction;

(f) determining a second load-displacement relation required for forming at a position of each forming punch using the first load-displacement relation that is obtained from the finite element analysis performed by the computer system; and (g) receiving information on the determined loads from a controller connected to the forming apparatus, performing numerical control on the hydraulic apparatus through the controller, and forming the to-be-worked metal plate loaded between the forming punches arranged at upper and lower positions so as to approximate the target curved surface.

2. The method according to claim 1, further comprising the step of, after the step (g), measuring the formed curved surface of the to-be-worked metal plate, and comparing the measured curved surface with the target curved surface.

3. The method according to claim 2, further comprising the step of, when the formed curved surface measured in the comparing step exceeds an allowable error range, feeding the to-be-worked metal plate back to the forming apparatus, and forming the to-be-worked metal plate again.

4. The method according to claim 1, wherein, in the finite element analysis of elasto-plastic large deformation in the step (d), a total amount of displacement required to be applied to each forming punch point is set in order to calculate a spring-back effect of the metal plate to form the target curved surface.

5. The method according to claim 4, further comprising the step of, after the step (g), measuring the formed curved surface of the to-be-worked metal plate, and comparing the measured curved surface with the target curved surface.

6. The method according to claim 5, further comprising the step of, when the formed curved surface measured in the comparing step is beyond an allowable error range, feeding the to-be-worked metal plate back to the forming apparatus, and forming the to-be-worked metal plate again.

7. The method according to claim 4, wherein the total amount of displacement required to be applied to each forming punch point is set using the following equations (1) and (2):

$$K=OA/OB \quad (1)$$

$$OE=OB/K \quad (2)$$

where OA is the amount of residual permanent deformation of the metal plate, OB is the total amount of displacement of each forming punch point on the targeted curved surface, and OE is the total amount of displacement required to be applied to each forming punch point.

8. The method according to claim 7, further comprising the step of, after the step (g), measuring the formed curved surface of the to-be-worked metal plate, and comparing the measured curved surface with the target curved surface.

9. The method according to claim 8, further comprising the step of, when the formed curved surface measured in the comparing step exceeds an allowable error range, feeding the to-be-worked metal plate back to the forming apparatus, and forming the to-be-worked metal plate again.

10. The method according to claim 4, wherein the total amount of displacement required to be applied to each forming punch point is set using the following equations (1) and (2):

$$AB=OB-OA=CD \quad (1)$$

$$OE=OB+CD \quad (2)$$

where OA is the amount of residual permanent deformation of the metal plate, OB is the total amount of displacement of each forming punch point on the targeted curved surface, and OE is the total amount of displacement required to be applied to each forming punch point.

11. The method according to claim 10, further comprising the step of, after the step (g), measuring the formed curved surface of the to-be-worked metal plate, and comparing the measured curved surface with the target curved surface.

12. The method according to claim 11, further comprising the step of, when the formed curved surface measured in the comparing step is beyond an allowable error range, feeding the to-be-worked metal plate back to the forming apparatus, and forming the to-be-worked metal plate again.

13. The method according to claim 1, further comprising the step of, between the step (e) and the step (f), analyzing a relationship between permanent deformation and elastic deformation of the to-be-worked metal plate at a position of each forming punch.

* * * * *